US009677158B2

(12) United States Patent
Wang et al.

(10) Patent No.: US 9,677,158 B2
(45) Date of Patent: Jun. 13, 2017

(54) ALUMINUM ALLOY SUITABLE FOR HIGH PRESSURE DIE CASTING

(71) Applicant: GM Global Technology Operations LLC, Detroit, MI (US)

(72) Inventors: Qigui Wang, Rochester Hills, MI (US); Wenying Yang, Rochester Hills, MI (US); Jason R. Traub, Sterling Heights, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 421 days.

(21) Appl. No.: 13/833,397

(22) Filed: Mar. 15, 2013

(65) Prior Publication Data

US 2014/0261907 A1 Sep. 18, 2014

(51) Int. Cl.

| | |
|---|---|
| ***C22C 21/04*** | (2006.01) |
| ***B22D 17/00*** | (2006.01) |
| ***C22F 1/043*** | (2006.01) |
| ***B22D 21/00*** | (2006.01) |

(52) U.S. Cl.

CPC ..... *C22C 21/04* (2013.01); *B22D 17/00* (2013.01); *B22D 21/007* (2013.01); *C22F 1/043* (2013.01)

(58) Field of Classification Search

CPC ..... C22C 21/02; C22C 21/06; C22C 21/08; C22F 1/043

USPC ..... 148/549, 415; 420/546, 541

See application file for complete search history.

(56) References Cited

U.S. PATENT DOCUMENTS

| | | | | |
|---|---|---|---|---|
| 6,168,675 | B1 | 1/2001 | Fang et al. | |
| 2003/0136477 | A1* | 7/2003 | Kitaoka et al. | 148/415 |
| 2005/0167012 | A1 | 8/2005 | Lin et al. | |
| 2005/0199318 | A1* | 9/2005 | Doty | C22C 21/02 148/439 |
| 2011/0100515 | A1* | 5/2011 | Lumley | C22C 21/02 148/438 |
| 2012/0000578 | A1* | 1/2012 | Wang et al. | 148/549 |

FOREIGN PATENT DOCUMENTS

| | | | |
|---|---|---|---|
| JP | 09272957 | A * | 10/1997 |
| RU | 1172285 | A1 * | 1/1996 |

* cited by examiner

*Primary Examiner* — Jessee Roe
*Assistant Examiner* — Jenny Wu

(57) ABSTRACT

Copper-free aluminum alloys suitable for high pressure die casting and capable of age-hardening under elevated temperatures are provided. The allow includes about 9.5-13 wt % silicon, about 0.2 to 0.6 wt % Magnesium, about 0.1 to 2 wt % iron, about 0.1 to 2 wt % manganese, about 0.1 to 1 wt % nickel, about 0.5 to 3 wt % zinc, and 0 to 0.1 wt % strontium, with a balance of aluminum. Methods for making high pressure die castings and castings manufactured from the alloy are also provided.

4 Claims, 9 Drawing Sheets

T6 = T4+T5 (under- or peak-aged)

T7 = T4+T5 (overaged)

Fig. 4

| Alloy | Si | Fe | Mn | Mg | Cu | Zn | Ni | Al | Eutectic phase (vol%) | Solidification range (°C) |
|---|---|---|---|---|---|---|---|---|---|---|
| A380 | 8.5 | 1 | 0.5 | 0.1 | 3.5 | 2 | 0.3 | 84.1 | 15.6 | 194 (634~440) |
| New alloy #1 | 11 | 1 | 1 | 0.4 | 0 | 2 | 0.3 | 84.3 | 15.8 | 138 (649~511) |
| New alloy #2 | 11 | 1 | 0.8 | 0.4 | 0 | 2 | 0.3 | 84.5 | 15.2 | 130 (641~511) |

FIGURE 5
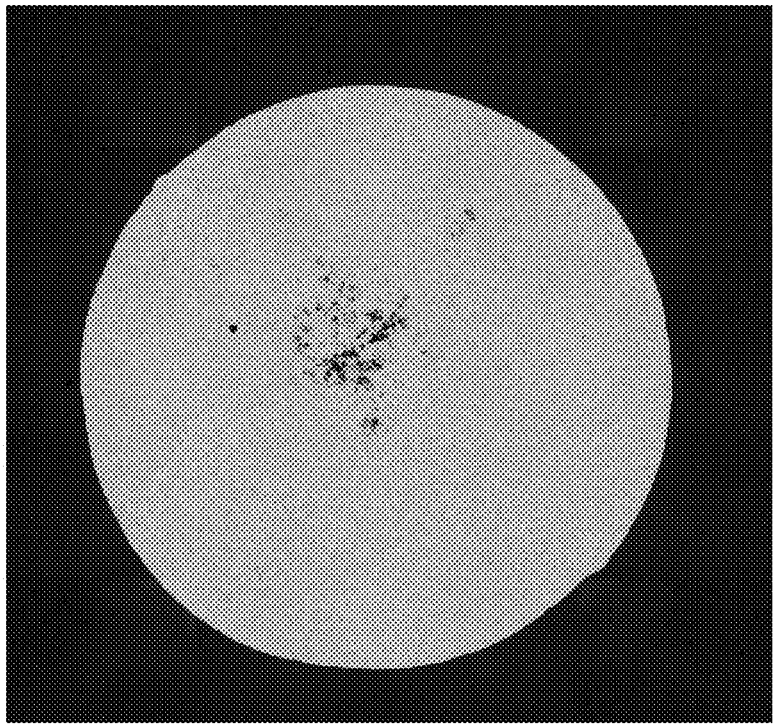
A380
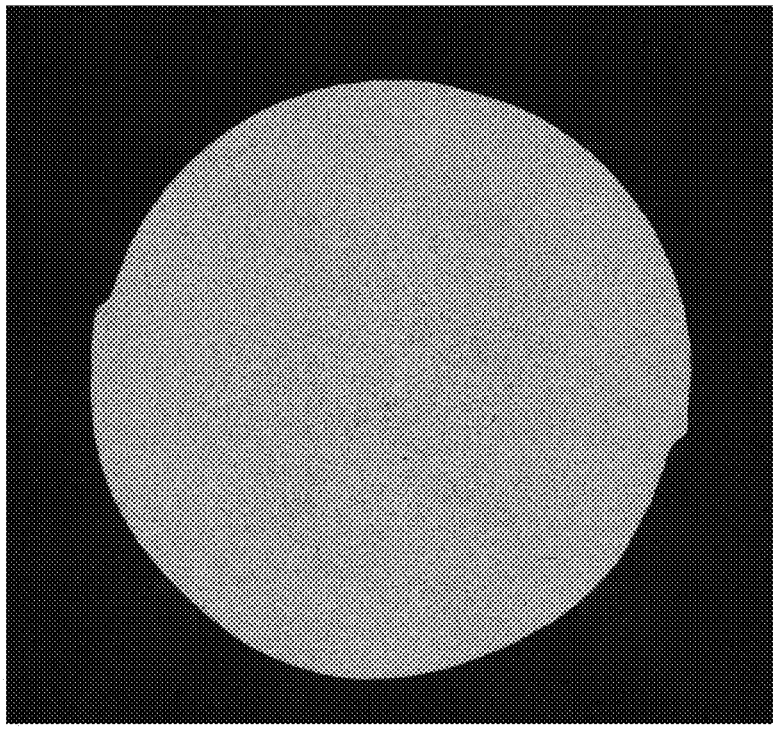
New Alloy E6

FIGURE 6
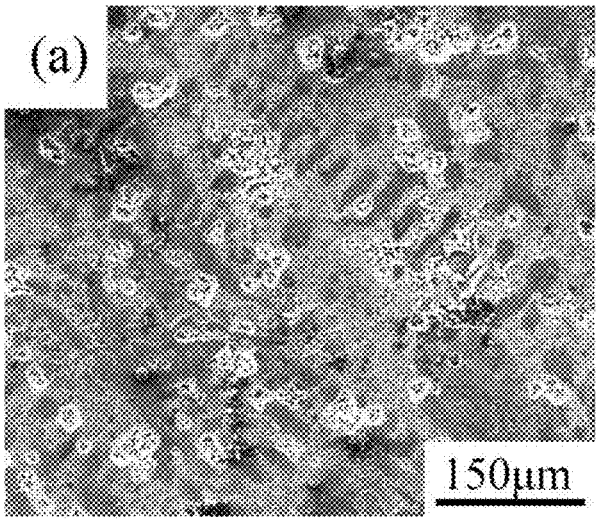
A380
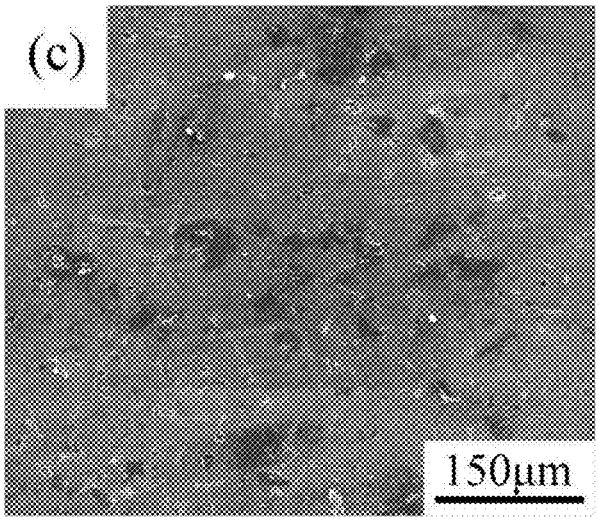
New Alloy

FIGURE 7
| Alloys* | Si (%) | Mg (%) | Fe (%) | Mn (%) | Zn (%) | Cu (%) | Sr (%) | Density (g/cm3) | Tensile (TS) | | | Corrossion Test | |
|---|---|---|---|---|---|---|---|---|---|---|---|---|---|
| | | | | | | | | | $\sigma_{0.2}$ (MPa) | UTS (MPa) | Strain (%) | Corrosion current density (A/cm$^2$) | Corrosion rate (mm/year) |
| A380 | 8.2 | 0.33 | 1.06 | 0.54 | 0.92 | 3.57 | <0.001 | 2.775 | 216.5 | 270.0 | 1.2 | $1.559 \times 10^{-6}$ | 0.150 |
| A360 | 9.5 | 0.46 | 0.89 | 0.57 | 1.02 | 0.56 | <0.001 | 2.705 | 225.4 | 256.3 | 0.7 | $1.419 \times 10^{-6}$ | 0.104 |
| GM_E3 | 11.1 | 0.4 | 1.1 | 0.78 | 2 | <0.01 | <0.001 | 2.719 | 247.0 | 268.5 | 0.6 | $1.044 \times 10^{-6}$ | 0.083 |
* Note: The tensile samples were sectioned from the HPDC part.
7A
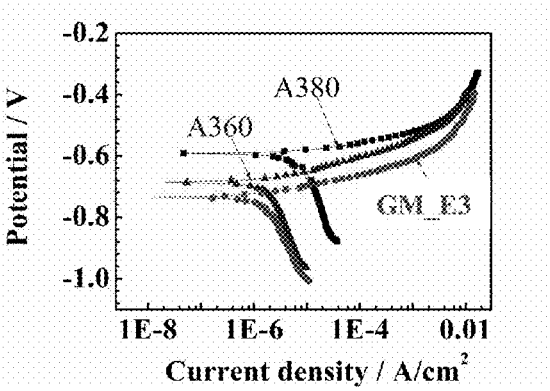
7B
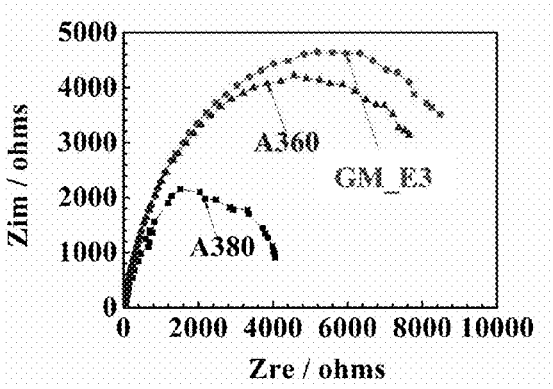
7C

FIGURE 8

| Alloys* | Si (%) | Mg (%) | Fe (%) | Mn (%) | Ni (%) | Zn (%) | Cu (%) | Sr (%) | AS-Cast | | | T5 | | |
|---|---|---|---|---|---|---|---|---|---|---|---|---|---|---|
| | | | | | | | | | $\sigma_{0.2}$ (MPa) | UTS (MPa) | Strain (%) | $\sigma_{0.2}$ (MPa) | UTS (MPa) | Strain (%) |
| A380-A | 8.4 | 0.05 | 0.53 | 0.05 | 0.01 | 0.05 | 3.5 | <0.001 | 120.36 | 158.20 | 1.03 | 145.59 | 203.39 | 0.91 |
| E1 | 8.4 | 0.1 | 0.98 | 0.5 | 0.51 | 2 | <0.01 | <0.001 | 99.27 | 168.56 | 1.20 | 132.73 | 173.04 | 0.76 |
| E2 | 8.5 | 0.36 | 0.5 | 0.5 | 0.52 | 1.9 | <0.01 | <0.001 | 99.91 | 181.90 | 1.99 | 149.95 | 205.83 | 1.21 |
| E3 | 11.5 | 0.44 | 0.97 | 0.5 | 0.49 | 2 | <0.01 | <0.001 | 122.13 | 164.69 | 0.74 | 164.46 | 175.19 | 0.54 |

* Note: The tensile samples were made in a PM mold with a gauge diameter of 12.7 mm.

| Alloys* | Si (%) | Mg (%) | Fe (%) | Mn (%) | Ni (%) | Zn (%) | Cu (%) | Sr (%) | AS-Cast | | | T5 | | |
|---|---|---|---|---|---|---|---|---|---|---|---|---|---|---|
| | | | | | | | | | $\sigma_{0.2}$ (MPa) | UTS (MPa) | Strain (%) | $\sigma_{0.2}$ (MPa) | UTS (MPa) | Strain (%) |
| A380-B | 8.3 | 0.11 | 0.93 | 0.43 | 0.45 | 1.9 | 3.4 | <0.001 | 143.61 | 187.78 | 0.72 | 182.28 | 185.68 | 0.43 |
| E4 | 10.9 | 0.37 | 1.1 | 0.98 | 0.51 | 2 | <0.01 | 0.015 | 132.87 | 171.88 | 0.62 | 196.03 | 205.30 | 0.41 |
| E5 | 11.1 | 0.4 | 1.1 | 0.78 | 0.51 | 2 | <0.01 | <0.01 | 140.90 | 156.80 | 0.49 | 183.46 | 188.18 | 0.32 |
| E6 | 11.1 | 0.44 | 1.1 | 0.73 | 0.5 | 2 | <0.01 | 0.015 | 143.35 | 172.92 | 0.60 | 194.03 | 198.58 | 0.34 |

* Note: The tensile samples were made in a PM mold with a gauge diameter of 12.7 mm.

FIGURE 9
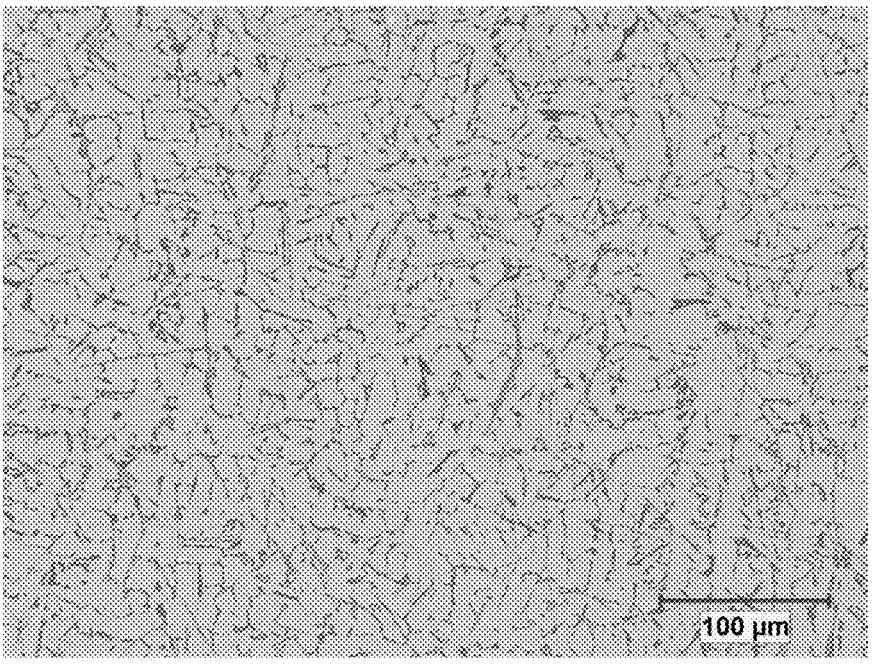
A380
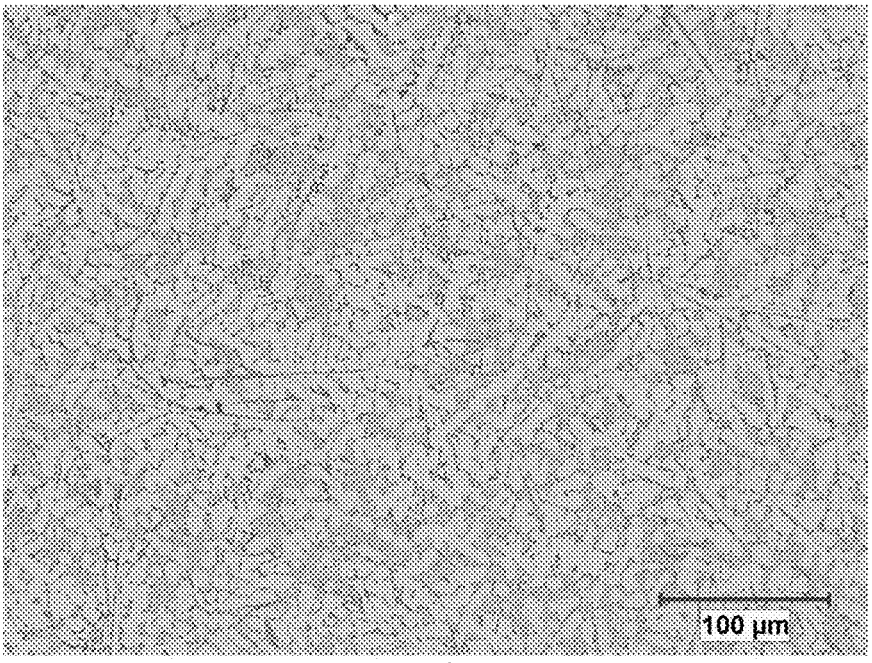
E6

ALUMINUM ALLOY SUITABLE FOR HIGH PRESSURE DIE CASTING

FIELD OF THE INVENTION

The invention relates generally to a copper-free aluminum alloy formulated for high pressure die casting (HPDC), and the castings therefrom, which are capable of age-hardening at elevated temperatures with reduced porosity, thus possessing superior mechanical properties for applications particularly in the automotive industry.

BACKGROUND OF THE INVENTION

HPDC is a cost-effective and wide-spread method for industrial production of metal components requiring precise dimensional consistency, low dimensional tolerances and where a smooth surface finish is important. Manufacturers in the car industry are now increasingly required to produce near-net-shape aluminum components with a combination of high tensile properties and ductility, and HPDC affords the most economic production method for large-scale quantities of small to medium sized components.

Aluminum alloy castings account for a majority of HPDC castings and are found, for example, in a wide range of automotive parts. In order to avoid discontinuities in the cast component, the molten alloy is injected into the die cavity rapidly enough that the entire cavity fills before any portion of the cavity begins to solidify. Hence, the injection is under high pressure and the molten metal is subject to turbulence as it is forced into a die and then rapidly solidifies. Since the air being replaced by the molten alloy has little time to escape, some of it is trapped and porosity results. Castings also contain pores resulting from gas vapor decomposition products of the organic die wall lubricants and porosity may also result from shrinkage during solidification.

A major drawback of the porosity resulting from the HPDC process is that aluminum alloy castings made from aluminums which ordinarily have the capacity to respond to age-hardening, cannot be artificially aged, that is, they cannot be treated at the high temperatures characteristic of artificial aging conditions. The internal pores containing gases or gas forming compounds in the high pressure die castings expand during conventional solution treatment at elevated temperatures, resulting in the formation of surface blisters on the castings. The presence of these blisters affects not only the appearance of castings but also dimensional stability and in some cases it can negatively impact particular mechanical properties of HPDC components. Specifically, aluminum alloy HPDC cast parts are not amenable to solution treatment (T4) at a high temperature, for example 500° C., which significantly reduces the potential of precipitation hardening through a full temper T6 and/or T7 (equivalently phrased as a combination of temper T4 and T5) heat treatment. It is nearly impossible to find a conventionally processed HPDC component without large gas bubbles.

In Al—Si casting alloys (e.g., alloys 319, 356, 390, 360, 380), strengthening is achieved through heat treatment after casting, with addition of various alloying hardening solutes including, but not limited to, Cu and Mg. The heat treatment of cast aluminum involves a mechanism described as age hardening or precipitation strengthening. Heat treatment (conventional T6 and/or T7 heat treatment) generally includes at least one or a combination of three steps: (1) solution treatment (also defined as T4) at a relatively high temperature below the melting point of the alloy, often for times exceeding 8 hours or more to dissolve its alloying (solute) elements and to homogenize or modify the microstructure; (2) rapid cooling, or quenching into a cold or warm liquid medium after solution treatment, such as water, to retain the solute elements in a supersaturated solid solution; and (3) artificial aging (T5) by holding the alloy for a period of time at an intermediate temperature suitable for achieving hardening or strengthening through precipitation. Solution treatment (T4) serves three main purposes: (1) dissolution of elements that will later cause age hardening, (2) spherodization of undissolved constituents, and (3) homogenization of solute concentrations in the material. Quenching after T4 solution treatment retains the solute elements in a supersaturated solid solution (SSS) and also creates a supersaturation of vacancies that enhances the diffusion and the dispersion of the precipitates. To maximize the strength of the alloy, the precipitation of all strengthening phases should be prevented during quenching. Aging (T5, either natural or artificial aging) creates a controlled dispersion of strengthening precipitates.

With T5 aging, there generally are three types of aging conditions (see FIG. 1), which are commonly referred as underaging, peak aging and over aging. At pre-aging, or an initial stage of aging, Guinier-Preston (GP) zones and fine shearable precipitates form and the casting is considered to be underaged. In this condition, mechanical properties of the casting, for example material hardness and yield strength, are usually low. Increased time at a given temperature or aging at a higher temperature further evolves the precipitate structure increasing mechanical properties such as hardness and yield strength to maximum levels for achieving the peak aging/hardness condition. Further aging decreases the hardness/yield strength and the casting becomes overaged due to precipitate coarsening and its transformation of crystallographic incoherency. FIG. 2 shows an example of aging responses of cast aluminum alloys A356/357 aged at a temperature of 170° C. For the period of aging time tested at giving aging temperature, the castings undergo underaged, peak aged, and overaged stages.

Considering that the conventional HPDC aluminum components inevitably contain internal porosity, artificial aging (T5) becomes a very important step in achieving the desired mechanical properties without causing blistering. The strengthening that results from aging occurs because the retained hardening solutes present in the supersaturated solid solution form precipitates that are finely dispersed throughout the grains and that increase the ability of the casting to resist deformation by slip and plastic flow. Maximum hardening or strengthening may occur when the aging treatment leads to the formation of a critical dispersion of at least one type of these fine precipitates.

In addition, in conventional HPDC processes the cast parts are often slowly cooled to a low temperature, for example, below 200 C, prior to die ejection and quench. This significantly diminishes the subsequent aging potential since the hardening solute solubility decreases significantly with decreasing quench temperature. As a result, the remaining hardening solute, such as Cu and Mg, available in the aluminum matrix for subsequent aging hardening is very limited. Although an alloy may contain 3~4% Cu in nominal composition, most of the Cu combines with other elements forming intermetallic phases. Without solution treatment, the Cu-containing intermetallic phases will not contribute to age hardening of the material. Therefore, addition of Cu in the current HPDC alloys used in production is not effective in terms of both property improvement and quality assurance.

Typical HPDC aluminum alloys are Al—Si based alloys that contain about 3~4% Cu. It is generally accepted that copper (Cu) has the single greatest impact of all alloying solutes/elements on the strength and hardness of aluminum alloy castings, both heat-treated and not heat-treated and at both ambient and elevated service temperatures. Cu is known to improve the machinability of alloys by increasing matrix hardness, making it easier to generate small cutting chips and fine machined finishes. On the downside, Cu generally reduces the corrosion resistance of aluminum castings; and in certain alloys and tempers, it increases stress corrosion susceptibility. Cu also increases the alloy freezing range and decreases feeding capability, leading to a high potential for shrinkage porosity.

Further, it has been reported that aluminum alloys with a high copper content (about 3-4%) have experienced an unacceptable rate of corrosion, especially in salt-containing environments. Typical high pressure die (HPDC) aluminum alloys, such as A 380 or 383, which are used for transmission and engine parts, contain 2-4% copper. It can be anticipated that the corrosion issue of these alloys will become more significant, particularly when longer warranty time and higher vehicle mileages are required.

Aluminum alloys have been developed to address some of the known problems, but the castings remain deficient as a whole. For example, Aluminum alloy A380 is a generally age-hardenable alloy with the composition (in wt. %) 9 Si, 3.1 Cu, 0.86 Fe, 0.53 Zn, 0.16 Mn, 0.11 Ni and 0.1 Mg (Lumley, R. N. et al. "Thermal characteristics of heat-treated aluminum high-pressure die-castings" 1 Scripta Materialia 58 (2008) 1006-1009, the entire disclosure of which is incorporated herein by this reference). The developers teach that the Cu-phases, such as the $Al_2Cu$ precipitate phase, are important to achieving the benefits of artificial aging, as well as for improving thermal conductivity of the casted part. However the castings suffer from lower corrosion resistance, a high potential for cast defects and a high material cost due to the percentage Cu.

It is known that reducing the Cu content improves the corrosion resistance of an aluminum alloyed material. However Cu is thought to be a necessary hardening component in HDPC aluminum castings. In previously published work, some of the present investigators recommended lower Cu content ranges of 0.5% to 1.5% by weight depending upon the as-cast and heat treatment conditions (see U.S. application Ser. No. 12/827,564, publication No. 20120000578, the entire disclosure of which is incorporated herein by this reference). Nonetheless the presence of Cu in the casting solution after solidification was considered integral to the preservation of acceptable mechanical properties, in particular hardness/yield strength of the cast.

Essentially Cu-free alloys, such as A356, are known in the art, however they are typically used in sand casting and/or semi-permanent mold casting processes other than HDPC and as formulated, suffer from the predicted deficiencies in mechanical properties such as poor tensile strength.

Lin (U.S. patent application Ser. No. 11/031,095) discloses an aluminum alloy having reduced a reduced Cu percentage; however Lin nonetheless teaches the importance of presence of some copper to the hardening process. Moreover, the Lin alloy formulations and castings contain low weight percentages of Si in order to avoid brittle Al—Si eutectic networks in the casted condition. The goal of Lin was to produce aluminum alloys suitable for thixoforming, a molding process which combines features of casting and forging involving low-pressure molding to produce particular microcrystalline structures and to avoid solution heat treatment. The alloys of Lin would be unsuitable for HPDC methods.

Clearly a need exists in the art for an aluminum alloy suitable for HPDC and amenable to age hardening, without compromising corrosion resistance or mechanical properties of the cast components.

SUMMARY OF THE INVENTION

Accordingly, the present disclosure provides substantially Cu-free aluminum alloys suitable for high pressure die casting and age-hardening at elevated temperatures with reduced porosity compared to known HPDC aluminum alloys. The castings exhibit enhanced mechanical properties for both room and elevated temperature structural applications.

An aluminum alloy according to invention is suitable for high pressure die casting processes and is capable of age hardening, providing superior mechanical properties after age hardening at elevated temperatures. Embodiments of the aluminum alloy are substantially free of copper and comprise by weight about 9.5 to 13% silicon (Si); about 0.2 to about 0.6% magnesium (Mg); and at least about 84% aluminum. An alloy may further comprise about 0.1 to 2 weight percent iron (Fe); and about 0.1 to 2 weight percent manganese (Mn), wherein the ratio of weight percent Mn:Fe is about 0.5~3, and the total amount of Mn+Fe is from about 0.5 to about 1.5 weight percent. Preferably, if the alloy is formulated with greater than about 1 weight % Fe, then the alloy should further comprise strontium (Sr). An alloy according to the disclosure may also include about 1 weight percent nickel (Ni) and about 0.5 to about 3.0 weight percent zinc (Zn). The above composition ranges may be adjusted based on performance requirements.

Other embodiments are directed to HPDC articles cast from an aluminum alloy according to the invention. An aluminum alloy is formulated such that the alloy exhibits a eutectic phase in the range of 15-16 volume percent and solidification occurs across a relative narrow temperature range when compared to known HPDC aluminum alloys. Embodiments directed to cast articles possess superior mechanical properties when age hardened, for example, under any of the temper T4, T5, T6 and T7 heat treatment protocols.

Further embodiments are directed to methods for manufacturing articles by HDPC of an aluminum alloy according to the invention. The methods comprise providing a molten aluminum alloy according to embodiments of the invention, injecting the molten aluminum alloy into a die under high pressure, solidifying the alloy in the die to form the casting, cooling the casting in the die to a quenching temperature, quenching the casting in a quenching solution, and subjecting the casting to one or more age-hardening treatments. The alloy is formulated such that the casting solidifies at a temperature range of from about 500° C. to about 650° C., and is age hardened such that the casting exhibits a eutectic phase in the range of 15-16 volume percent.

These and additional aspects and embodiments will be more clearly understood in view of the detailed description and figures set forth below.

BRIEF DESCRIPTION OF THE FIGURES

The following detailed description of specific embodiments can be best understood when read in conjunction with the following drawings:

FIG. 4. sets forth a Table comparing prior art cast aluminum alloy A380 with exemplary cast alloys according to specific embodiments of the invention.

FIG. 5. is a comparison of micrographs of a tensile sample of A380 alloy showing porosity (block) in the central part of the specimen, and a tensile sample of an embodiment E6 according to the invention showing almost no porosity in the central part of the specimen.

FIG. 6. is a comparison of micrographs of tensile samples of A380 alloy and an alloy embodiment according to the invention after immersing both samples in 3.5% NaCl solution for 240 h.

FIG. 7. sets forth empirical data and graphical representations thereof comparing tensile properties and corrosion resistance and corrosion conductivity in samples taken from T5 HDPC alloys A380, A360 and a specific embodiment E3 according to the invention. 7A is a table of Tensile (T5) data comparing tensile samples sectioned from HDPC casts of A380, A360; 7B sets forth a graphical representation of corrosion current density of the three samples, and 7C sets forth a graphical representation of corrosion rate of the three samples.

FIG. 8. sets forth tabled empirical data comparing tensile properties in as-cast and T5-aged HDPC samples cast from known alloy A380 and six specific alloy embodiments according to the invention.

FIG. 9. is a comparison of micrographs showing the microstructures of a T5-aged HDPC article cast from exemplary HDPC alloy A380 and a T5-aged HDPC article cast from a specific alloy E6 according to an embodiment of the invention.

DETAILED DESCRIPTION OF THE INVENTION

Figure 1:
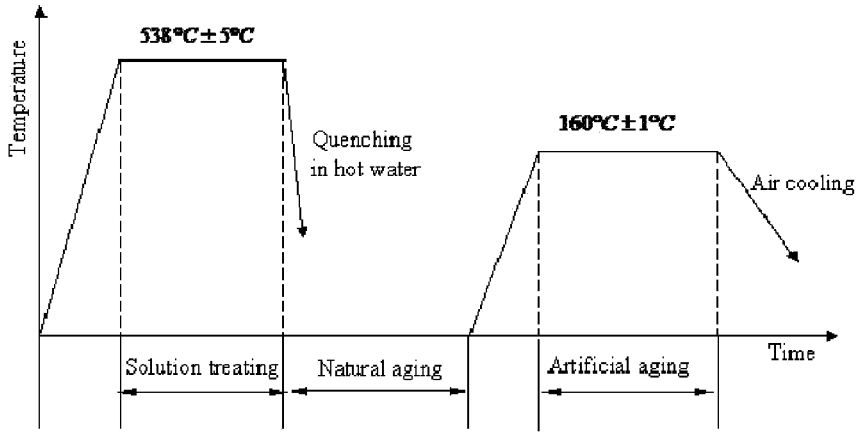
FIG. 1. illustrates a typical T6 and/or T7 heat treatment cycle for an aluminum alloy.
Figure 2:
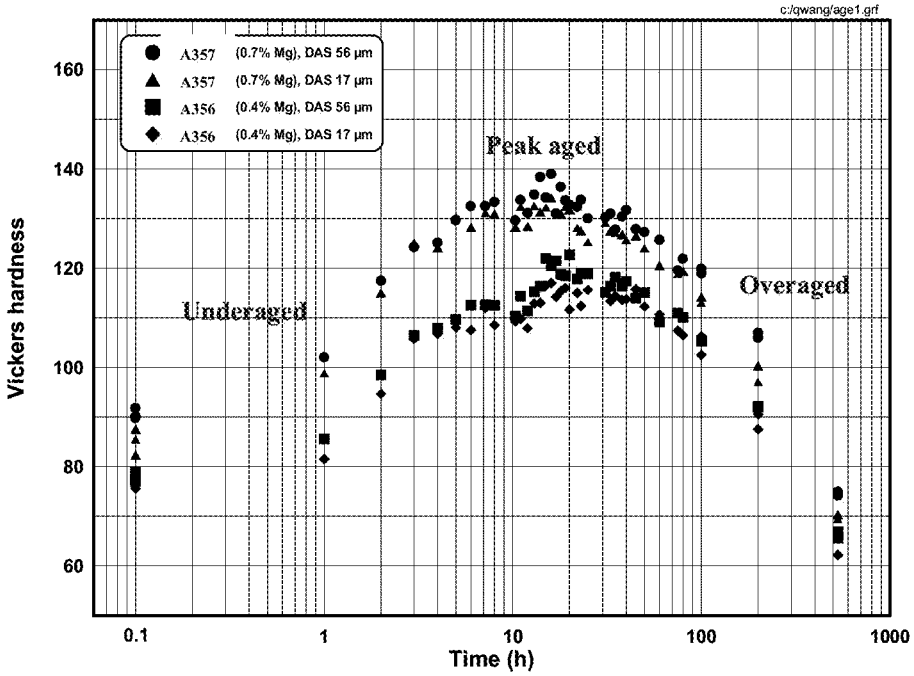
FIG. 2. is a graphical illustration of aging responses of cast aluminum alloys A356/A357 aged at 70° C. according to the prior art.

Embodiments of the disclosure relate generally to substantially Cu-free aluminum alloys formulated to provide HPDC casted components capable of age-hardening at elevated temperatures and exhibiting superior mechanical properties and reduced porosity. Unlike aluminum-based copper containing alloy castings known in the art, the instant castings are capable of a full range of temper age-hardening treatments.

As used herein, "castings" refer generally to aluminum alloy high pressure die castings formed through solidification of aluminum alloy compositions. Thereby, the castings may be referred to herein during any stage of a high pressure die casting process and/or a heat treatment process subsequent to solidification, whether cooling, quenching, aging, or otherwise. Further, castings may include any part, component, product formed via an embodiment of the present invention.

Further, as used herein, "mechanical property," and related phrases thereof, refer generally to at least one and/or any combination of, strength, hardness, toughness, elasticity, plasticity, brittleness, and ductility and malleability that measures how a metal, such as aluminum and alloys thereof, behaves under a load. Mechanical properties generally are described in terms of the types of force or stress that the metal must withstand and how these are resisted.

As used herein, "strength" refers to at least one and/or any combination of yield strength, ultimate strength, tensile strength, fatigue strength, and impact strength. Strength refers generally to a property that enables a metal to resist deformation under a load. Yield strength refers generally to the stress at which a material begins to deform plastically. In engineering, the yield strength may be defined as the stress at which a predetermined amount (for instance about 0.2%) of permanent deformation occurs. Ultimate strength refers generally to a maximum strain a metal can withstand. Tensile strength refers generally to a measurement of a resistance to being pulled apart when placed in a tension load. Fatigue strength refers generally to an ability of a metal to resist various kinds of rapidly changing stresses and may be expressed by the magnitude of alternating stress for a specified number of cycles. Impact strength refers generally to the ability of a metal to resist suddenly applied loads. Generally, the higher the yield strength, the higher the other strengths are as well.

As used herein, "hardness" refers generally to a property of a metal to resist permanent indentation. Hardness generally is directly proportional to strength. Thus, a metal having a high strength also typically has high hardness.

Aluminum alloy compositions solidified to form castings are known to comprise a number of elements, such as, but not limited to, aluminum (Al), silicon (Si), magnesium (Mg), copper (Cu), iron (Fe), manganese (Mn), zinc (Zn), nickel (Ni), titanium (Ti), strontium (Sr), etc. The elements and their respective concentrations that define an aluminum alloy composition may affect significantly the mechanical properties of the casting formed therefrom. More particularly, some elements may be referred to as hardening solutes. These hardening solutes may engage and/or bond among themselves and/or with other elements during solidification, cooling, quenching, and aging of casting and heat treatment processes. Aging generally is used to strengthen castings. While, various processes for aging are available, generally only some are applicable and/or sufficiently effective for aluminum alloy high pressure die casting processes, for reasons described above. Aluminum alloy castings known to the high pressure die casting arts have generally been limited to temper T5 treatment aging (natural or artificial). Aging strengthens castings by facilitating the precipitation of the hardening solutes of the aluminum alloy composition.

Artificial aging (T5) heats the castings to an elevated, typically intermediate, temperature for a length of time sufficient to strengthen the casting through precipitation of the hardening solutes. Since precipitation is a kinetic process, the respective concentrations (supersaturation) of the hardening solutes available for precipitation are significant to the casting's strengthening response to aging. Therefore, the concentrations of hardening solutes, and the availability thereof for precipitation, significantly impact the extent to which the casting is strengthened during aging. If the hardening solutes are prevented, or substantially prevented, from bonding among themselves and/or with other elements prior to the aging, then the hardening solutes may precipitate during aging to strengthen the casting.

To prevent, or at least substantially prevent, the hardening solutes from bonding among themselves and/or with other elements of the aluminum alloy composition prior to aging and, thereby, maintain the availability of the hardening solutes, the casting is cooled to a quenching temperature in the die and quenched immediately thereafter. To facilitate the cooling of the casting to the quenching temperature, an embodiment may comprise selectively heating and/or cooling one or more designated areas of the casting prior to its removal from the die for quenching.

Further, to increase precipitation during aging, and, thereby, enhance mechanical properties of castings, one or more specific hardening solutes typically are incorporated into the aluminum alloy composition. Traditionally it has been accepted in the art that magnesium (Mg), copper (Cu), and silicon (Si) are particularly effective and even necessary as hardening solutes in aluminum alloys. Mg may combine with Si to form Mg/Si precipitates, such as β", β', and equilibrium Mg2Si phases. The precipitate types, sizes, and concentrations typically depend on the present aging conditions and the compositions of the aluminum alloys. For example, underaging tends to form shearable β" precipitates, while peak-aging and over-aging generally form unshearable β' and equilibrium Mg2Si phases. When aging aluminum alloys, Si alone can form Si precipitates. Si precipitates, however, generally are not as effective as Mg/Si precipitates in strengthening aluminum alloys. Further, Cu can combine with aluminum (Al) to form multiple metastable precipitate phases, such as θ' and θ, in Al—Si—Mg—Cu alloys, which are known to be very effective in strengthening.

It is also widely accepted that increased concentrations of the more effective hardening solutes may be incorporated into the aluminum alloy composition to increase their availability for precipitation at aging. According to specifications for conventional aluminum alloy compositions for HPDC, generally the maximum Mg concentration incorporated is less than 0.1% by weight of the respective compositions. In industry practice, however, the Mg concentrations in such aluminum alloy compositions tend to be much lower than 0.1%. As a result, the compositions generally have an inability to form Mg/Si precipitates and, as such, minimal strengthening of the casting through Mg/Si precipitation results, even during T5 aging processes. In fact, it is generally accepted that the only feasible strengthening of the casting in this case results through formation of Al/Cu precipitates. Cu, therefore, has been considered a necessary hardening solute in aluminum-silicon alloys in HPDC operations.

Figure 3:
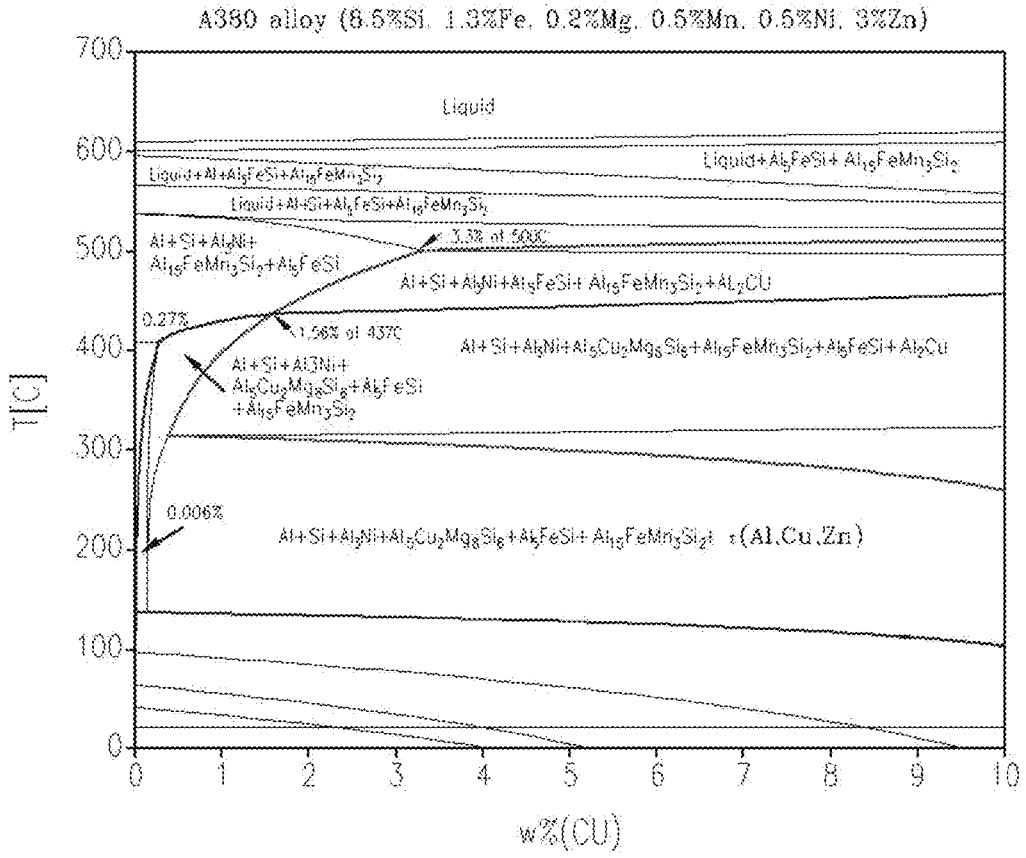
FIG. 3. sets forth a calculated phase diagram of a cast aluminum alloy known in the art (A380 HPDC alloy) showing phase transformations as a function of copper content.

However, when subjecting an HPDC casting to desirable age-hardening temper treatments, the hardening efficacy and contribution of Cu may be surprisingly limited. Although typical HPDC aluminum alloys, such as A380, 380 or 383, contain 3~4% Cu in nominal composition, the actual Cu solute remaining in as-cast aluminum matrix for the subsequent aging is actually much reduced. As shown in FIG. 3, the Cu content in the aluminum matrix is only about 0.006% even when the casting is quenched at about 200 C. A majority of the Cu is tied up during solidification with Fe and other elements forming intermetallic phases which have no aging responses if the components/parts do not undergo high temperature solution treatment. In this case, the role the Cu-containing intermetallic phases play in the strain-hardening is similar to other second phase particles like Si. The contribution of Cu to the aging hardening is actually negligible. Therefore, contrary to conventional regarding the importance of Cu as a hardening solute, the present investigators surprisingly discovered that Cu may be removed from the alloy if the composition is otherwise formulated within particular parameters to achieve substantially Cu-free aluminum alloys which provide HPDC castings with greater corrosion resistance, and some superior mechanical properties.

Accordingly, one embodiment of the invention provides an aluminum alloy suitable for HPDC processes and capable of temper age-hardening at elevated temperatures. The alloy comprises at least about 84 weight percent aluminum (Al); about 9.5 to about 13 weight percent silicon (Si); about 0.2 to about 0.6 weight percent magnesium (Mg); and is substantially free of copper (Cu). Mg and Si are effective hardening solutes. Mg combines with Si to form Mg/Si precipitates such as β", β' and equilibrium $Mg_2Si$ phases. The actual precipitate type, amount, and sizes depend on aging conditions and particularly the Mg and Si content remained in the matrix after casting. Compared with Cu, the solubility of Si and Mg in aluminum matrix is higher. Also, the diffusivity of Mg and Si in the aluminum matrix is higher than Cu. Increasing Si near the eutectic composition (~12%) can also help reduce freezing range and thus increase castability and quality of the casting. Mg and Si are both lighter and more cost-effective than Cu.

Ideally, a Cu-free aluminum alloy should produce a similar quantity of second phase particles in the microstructure after solidification. The alloy also should contain iron (Fe) to avoid die soldering. Fe, however, can easily form an undesirable needle-shape intermetallic phase if manganese (Mn) is not added in appropriately proportional amounts. It is suggested to keep the ratio of the quantity of Mn to the quantity of Fe greater than approximately 0.5.

According to other embodiments, the aluminum alloy further comprises: about 0.1 to 2 weight percent Fe; about 0.1 to 2 weight percent Mn; wherein the ratio of weight percent Mn:Fe is about 0.5 to about 3, and the total amount of Mn+Fe is from about 0.5 to about 1.5 weight percent. In more specific embodiments the ratio of weight percent Mn:Fe is between about 1.0 and 2, and the total amount of Mn+Fe is from about 0.8 to about 1.2%. Where the alloy comprises a weight percent Fe greater than about 1.0, then the alloy should further comprise strontium (Sr) at about 500 ppm. In other specific embodiments the alloy further comprises about 0.1 to 1 weight percent nickel (Ni); about 0.5 to 3.0 weight percent zinc (Zn); and about 0 to 0.1 weight percent strontium (Sr). According to a very specific embodiment, an aluminum alloy suitable for HPDC and capable of age-hardening consists essentially of: at least about 84 to about 90 weight percent aluminum (Al); about 9.5 to about 13 weight percent Si; about 0.2 to about 0.6 weight percent Mg; about 0.1 to about 2 weight percent Fe; about 0.1 to about 2 weight percent Mn; about 0.1 to about 1 weight percent Ni; about 0.5 to about 3.0 weight percent Zn; and about 0 to about 0.1 weight percent Sr. In a still more specific embodiment, the aluminum alloy consists essentially of: about 11 weight percent Si; about 0.4 weight percent Mg; about 1.0 weight percent Fe; about 0.8 to about 1.0 weight percent Mn; about 0.3 weight percent Ni; about 2.0 weight percent Zn; and a balance of Al. An amount of all other trace elements should comprise no more than about 0.25 weight percent of the alloy.

Table 1 of FIG. 4 sets forth a comparison of the calculated quantity of second phase particles and the solidification freezing range between two illustrative specific embodiments according to the invention and the conventional A380 HPDC alloy. Notably, after solidification the illustrative inventive alloys have similar amounts of eutectic phase particles but the solidification range decreases near 60° C., which is desirable for the casting quality (low shrinkage porosity). Therefore, an aluminum alloy according to the invention will possess similar as-cast tensile properties as A380, but will possess superior properties after temper T5 treatment. In accordance with some embodiments, a substantially Cu-free aluminum casting according to the disclosure is age-hardened at temper T5 or T6/T7 and exhibits a eutectic phase in the range of 15-16 volume percent.

Referring to FIG. 5, micrographs of specimens of A380 alloy (top) and an alloy E6 according to the invention (bottom) are set forth for comparison. The tensile sample of A380 alloy shows porosity (block) in the central portion of the specimen; whereas a tensile sample of a specific embodiment E6 shows almost no porosity in the central portion of the specimen. The ability to age-harden at elevated temperatures with reduced porosity provides casts having superior mechanical properties specifically suitable for applications in the automotive industry.

As evidenced by the micrographs set forth as FIG. 6, casts made from alloys according to the invention possess superior corrosion resistance when compared to state-of-the art HPDC alloy A380. A key benefit afforded by the inventive alloys is that the corrosion problems known in the art as associated with Cu content may be eliminated without compromising the strength of the HPDC cast article. FIG. 7 further illustrates this point. 7A is a tabled collation of data generated in an experiment testing and comparing HDPC cast samples from known HDPC A380 and A360 alloys and specific alloy embodiment E3 according to the invention. The casts were subject to T5 aging. Compositions, tensile properties of the casts, and corrosion conductivity data are all displayed for comparison purposes. Corrosion conductivity is also graphically represented in FIGS. 7B and 7C. Inspection of the data reveals that E3, which does not contain Cu, possesses much better corrosion resistance compared with the existing HPDC alloys exemplified by A380 and A360. Further, E3 has at least similar as-cast tensile properties, but better aging response and thus higher tensile strengths after T5 heat treatment in comparison with exemplary HDPC alloys A380 and A360. Notably the alloy according to the invention is also slightly lighter providing an additional cost efficiency benefit.

FIG. 8 sets forth tabled empirical data for two sets of experiments comparing tensile properties in as-cast and T5-aged HDPC samples cast from known alloy A380 and six specific alloy embodiments according to the invention. The tensile samples were made in a permanent mold (PM mold) with a gauge diameter of 12.7 mm. The 1st set of experimental results indicate that casts from specific inventive alloy embodiments E1-E3 possess at least equivalent or better as-cast and T5 mechanical properties than the A380 alloy in PM mold casting. The 2nd set of experimental results indicate that casts from specific inventive alloy embodiments E4-E6 also possess at least equivalent or better as-cast and T5 mechanical properties than the A380 alloy in permanent mold (PM) casting.

According to another embodiment, an HPDC article cast from a substantially Cu-free aluminum alloy formulated according to the disclosure is provided. Unlike conventional Cu-containing alloys, the Cu-free alloy may undergo effective temper T4, T5 or T6/T7 age-hardening treatments. In specific embodiments, the cast article is age hardened at temper T4 treatment temperatures of at least 500° C. The cast article may exhibit a microstructure comprising at least one or more of the insoluble solidified and/or precipitated particles with at least one alloying element selected from the group consisting of Al, Si, Mg, Fe, Mn, Zn, Ni, Sr. As evidenced by FIG. 9, the microstructure of an exemplary known HDPC Cu-containing alloy, A380 contains large eutectic particles after T5 aging conditions, whereas the microstructure of an exemplary alloy according to embodiments of the invention, E6, possesses smaller eutectic particles. Notably, the as-cast E6 article exhibits an equivalent volume fraction of eutectic particles in comparison with A380, but has much more narrow freezing range which is good for casting quality.

According to other embodiments, an HPDC manufacturing process is provided wherein a molten substantially Cu-free aluminum alloy is provided and cast into a die under high pressure. The alloy solidifies in the die to form the casting, and the casting in the die is permitted to cool to a desired quenching temperature, which is generally empirically determined. The casting may be removed from the die and quenched in a quenching solution. The casting may be subject to one or more age-hardening temper treatments including T4 (solution heat-treated and aged at ambient temperatures), T5 (cooled and then artificially aged at elevated temperatures), T6 (solution heat treated and artificially aged at elevated temperatures), and T7 (solution heat treated and stabilized). In specific method embodiments a casting according to the disclosure solidifies at a temperature of from about 500° C. to about 650° C. and exhibits a eutectic phase in the range of 15-16 volume percent. In specific embodiments the casting solidifies at a temperature of over 500° C. in a temperature range of less than 140 degrees.

According to very specific embodiments, the method of manufacturing a high pressure die casting of an aluminum alloy comprises: providing a molten aluminum alloy consisting essentially of at least about 84-90 weight percent aluminum (Al), about 9.5 to about 13 weight percent silicon (Si), about 0.2 to about 0.6 weight percent magnesium (Mg), about 0.1 to 2 weight percent iron (Fe); about 0.1 to 2 weight percent manganese (Mn), about 0.1-1 weight percent nickel (Ni) about 0.5-3.0 weight percent zinc (Zn), and about 0-0.1 weight percent strontium (Sr); casting the molten aluminum alloy into a die under high pressure; solidifying the alloy in the die to form the casting; cooling the casting still in the die to a quenching temperature; quenching the casting in a quenching solution; and subjecting the casting to a T5 age-hardening treatment, wherein the casting exhibits a eutectic phase in the range of 15-16 volume percent and solidifies at a temperature range of from about 500° C. to about 650° C.

It is noted that terms like "generally," "commonly," and "typically," when utilized herein, are not utilized to limit the scope of the claimed embodiments or to imply that certain features are critical, essential, or even important to the structure or function of the claimed embodiments. Rather, these terms are merely intended to identify particular aspects of an embodiment or to emphasize alternative or additional features that may or may not be utilized in a particular embodiment.

For the purposes of describing and defining embodiments herein it is noted that the terms "substantially," "significantly," and "approximately" are utilized herein to represent the inherent degree of uncertainty that may be attributed to any quantitative comparison, value, measurement, or other representation. The terms "substantially," "significantly," and "approximately" are also utilized herein to represent the degree by which a quantitative representation may vary from a stated reference without resulting in a change in the basic function of the subject matter at issue.

Having described embodiments of the present invention in detail, and by reference to specific embodiments thereof, it will be apparent that modifications and variations are possible without departing from the scope of the embodiments defined in the appended claims. More specifically, although some aspects of embodiments of the present invention are identified herein as preferred or particularly advantageous, it is contemplated that the embodiments of the present invention are not necessarily limited to these preferred aspects.

What is claimed:

1. An aluminum casting alloy capable of temperature-elevated age-hardening, the alloy comprising: at least about 84 weight percent aluminum (Al); about 9.5 to about 13 weight percent silicon (Si); about 0.2 to about 0.6 weight percent magnesium (Mg); about 1 to 2 weight percent iron (Fe); and about 0.1 to 2 weight percent manganese (Mn); about 0.1 to 1 weight percent nickel (Ni); about 0.5 to 3.0 weight percent zinc (Zn); and about 0.1 weight percent [500 ppm] strontium (Sr); wherein the ratio of weight percent Mn:Fe is about 0.5 to about 3, and the total amount of Mn+Fe is from about 0.5 to about 1.5 weight percent, further wherein the alloy is free of copper (Cu), and further wherein the alloy exhibits a eutectic phase in the range of 15-16 volume percent and solidifies at a temperature of from about 500° C. to about 650° C.

2. The alloy according to claim 1, wherein the ratio of weight percent Mn:Fe is between about 1.0 and 2, and the total amount of Mn+Fe is from about 0.8 to about 1.2 wt %.

3. An aluminum alloy capable of age-hardening, the alloy consisting essentially of: at least about 84 to about 90 weight percent aluminum (Al); about 9.5 to about 13 weight percent silicon (Si): about 0.2 to about 0.6 weight percent magnesium (Mg); about 1.0 to about 2 weight percent iron (Fe); about 0.1 to about 2 weight percent manganese (Mn); about 0.1 to about 1 weight percent nickel (Ni); about 0.5 to about 3.0 weight percent zinc (Zn); and about 0.1 weight percent strontium (Sr);

wherein the alloy is free of copper and exhibits a eutectic phase in the range of 15-16 volume percent.

4. An aluminum alloy capable of age-hardening according to claim 3, the alloy consisting essentially of: about 11 weight percent Si; about 0.4 weight percent Mg;

about 1.0 weight percent Fe;

about 0.8 to about 1.0 weight percent Mn, about 0.3 weight percent Ni;

about 2.0 weight percent Zn;

about 0.1 weight percent Sr; and a balance of Al wherein the alloy is free of copper and exhibits a eutectic phase in the range of 15-16 volume percent.

* * * * *